United States Patent [19]

Eber

[11] Patent Number: 4,770,003

[45] Date of Patent: Sep. 13, 1988

[54] BAR CABINET WITH ABSORPTION COOLING UNIT

[76] Inventor: Nicolas J. Eber, P.O. Box 130, 8103 Unterengstringen, Switzerland

[21] Appl. No.: 7,327

[22] Filed: Jan. 27, 1987

[30] Foreign Application Priority Data

Feb. 4, 1986 [CH] Switzerland ..... 00408/86

[51] Int. Cl.[4] ..... F25D 23/13

[52] U.S. Cl. ..... 62/258; 62/298; 62/452; 62/453; 62/457

[58] Field of Search ..... 62/249, 254, 258, 476, 62/112, 457, 236, 237, 298, 302, 448, 449, 447, 252, 253, 452, 453

[56] References Cited

U.S. PATENT DOCUMENTS

| | | | |
|---|---|---|---|
| 2,042,373 | 5/1936 | Wenander | 62/298 X |
| 2,170,717 | 8/1939 | Hull | 62/258 |
| 2,180,460 | 11/1939 | Earle | 62/258 |
| 2,311,817 | 2/1943 | Constable et al. | 62/258 |
| 2,467,464 | 4/1949 | Carriere | 62/452 X |
| 2,562,811 | 7/1951 | Muffly | 62/453 X |
| 2,642,728 | 6/1953 | Thomaras | 62/457 X |
| 3,065,609 | 11/1962 | West | 62/112 X |
| 4,009,593 | 3/1977 | Davis | 62/252 X |

FOREIGN PATENT DOCUMENTS

| | | | |
|---|---|---|---|
| 517204 | 10/1955 | Canada | 62/453 |
| 1017631 | 10/1957 | Fed. Rep. of Germany | 62/258 |

*Primary Examiner*—Lloyd L. King
*Attorney, Agent, or Firm*—Kenyon & Kenyon

[57] ABSTRACT

Bar cabinet (1) with refrigerated (2) and non refrigerated compartment (3) with substantially reduced depth suitable to be hanged on a wall, at eye's height, whereby the survey of and the access to their content is essentially improved. The reduction of the depth is achieved, firstly, through the arrangement of the non cold parts of the absorption cooling unit (10) behind the non refrigerated compartment (3) which is placed beside the refrigerated compartment (2) and, secondly, through the arrangement of the evaporator (11) within the thermal insulation (4) of the refrigerated compartment (2).

19 Claims, 1 Drawing Sheet

Fig. 1.
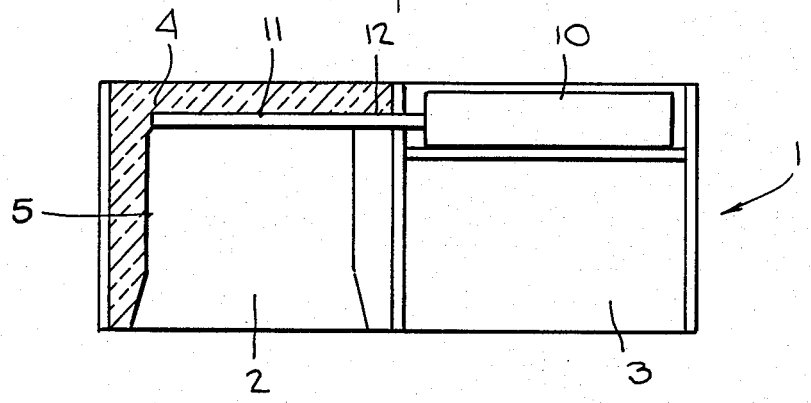
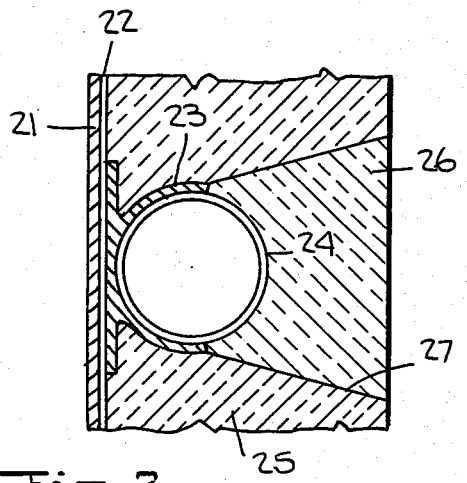
Fig. 2.
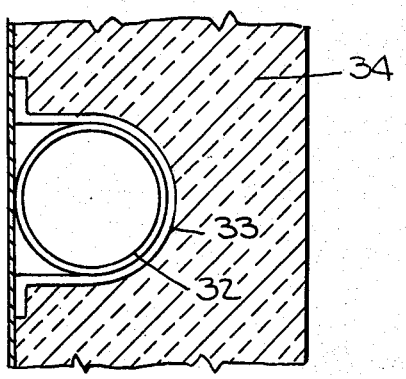
Fig. 3.
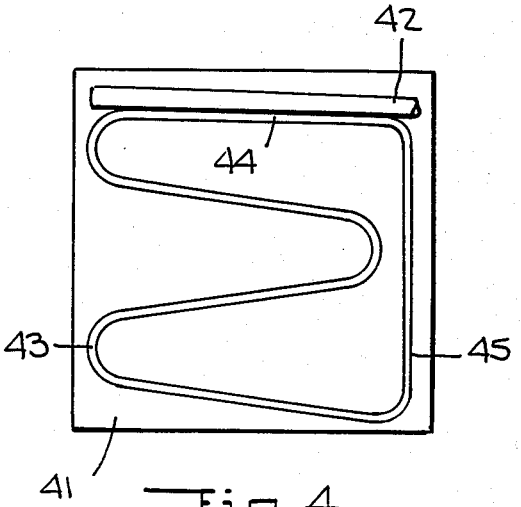
Fig. 4.
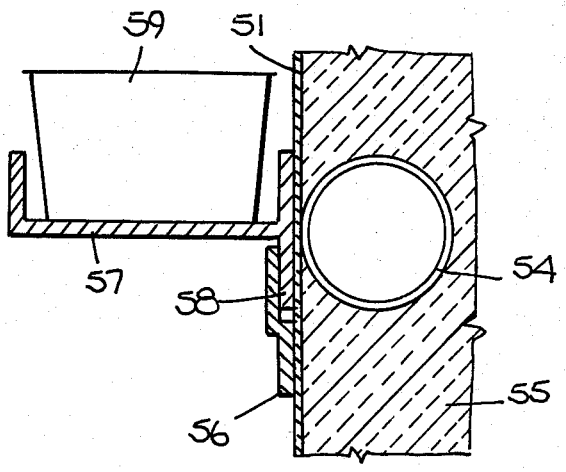
Fig. 5.

BAR CABINET WITH ABSORPTION COOLING UNIT

The invention concerns bar cabinets with absorption cooling unit.

Bar cabinets are mainly used in hotel guest rooms, offices and living rooms for the refrigerated storage of beverages and ice cube making. Mostly they have besides the refrigerated compartment also a non refrigerated one, foreseen for the storage of glasses, not to be refrigerated beverages, snacks, etc.

Since for such applications the absence of noise and vibrations is an essential requirement, bar cabinets are usually equipped with absorption cooling units without mechanically moved parts.

In the most popular bar cabinet design, the non refrigerated compartment is to be found above the refrigerated compartment, its door can be locked, its outside is covered with wooden panels and it usually stands on rollers.

This design has several disadvantages. Firstly, it occupies floor area which is mostly scarce and frequently not at all available for the bar cabinet. Secondly, the survey and usage, i.e. the taking off and filling up of its contents at its low level near the floor is cumbersome.

Designs of bar cabinets with refrigeration which are widely used and which became known so far, were decisively influenced by the design of the available absorption cooling units. This is the final reason that they are so little practical and comfortable.

More precisely, the absorption cooling units with pressure equalising gas, known so far, were not of such design to enable the more appropriate suspension of the bar cabinet on a wall at eye level.

Firstly, because the cooling units had to be placed directly behind the insulation of the refrigerated compartment 3, the cooling units occupied 8 to 10 cm depth. Secondly, because the refrigerating part of the cooling unit, the evaporator, penetrated into the refrigerated compartment, a minimum amount of space and depth was required. As a consequence, the minimum depth of bar cabinets known so far amounted to about 38 centimeters which made them practically and aesthetically unsuitable for hanging on the wall.

The present invention eliminates these disadvantages through a novel design and arrangement of both the absorption cooling unit and the bar cabinet.

Briefly, the invention provides a bar cabinet wherein non refrigerated compartment is arranged beside the refrigerated compartment and the non refrigerated parts of the cooling unit are arranged behind the non refrigerated compartment. In addition, an absorption cooling unit is disposed behind the non-refrigerated compartment and has an evaporator pipe extending therefrom into direct heat-conductive contact with a wall of the refrigerated compartment.

The inside wall of the thermally refrigerated and insulated compartment consists either entirely or partially of material with high thermal conductivity, preferably aluminium sheet, or it is covered, on its side facing the thermal insulation, entirely or partially with material of high thermal conductivity and is cooled by contact with the evaporator which is arranged outside the refrigerated space and within the thermal insulation.

By means of the present invention it is possible to build refrigerated bar cabinets with reduced total depths of only 25 to 30 cm, having nevertheless sufficient useful depth. Such refrigerated bar cabinets can be hanged on a wall in a practically and aesthetically satisfactory way, at about eye's level. Therefore it is usually easy to find a place for them and their content can be easily surveyed and comfortably taken off or filled up.

In the following the invention will be described by means of figures as examples.

The figures show:

FIG. 1. a schematical arrangement of the compartments and of the cooling unit;

FIG. 2. and FIG. 3. each a vertical cut through the rear wall of the refrigerated compartment;

FIG. 4. the schematical arrangement of a secondary cooling system;

FIG. 5. an arrangement for ice cube making.

FIG. 1 shows, schematically, a refrigerated bar cabinet 1, without door, in a horizontal cut. The refrigerated compartment 2 has a thermal insulation 4, preferably consisting of rigid polyurethane foam. The inside wall 5 of the refrigerated compartment 2 having a refrigerated compartment 2 and a non-refrigerated compartment 3 may consist, as until now usual, of plastic or at least partially of good heat conducting material, preferably aluminium sheet. If the inside wall 5 of the refrigerated compartment 2 is made of plastic, then it is covered, on its side facing the thermal insulation 4, entirely or partly with good heat conducting material.

The evaporator pipe 11 of the absorption cooling unit 10 is in direct contact with the inside wall 5 of the refrigerated compartment 2 and is to be found within the thermal insulation 4. The other, not cold parts of the absorption cooling unit 10 are arranged behind the non refrigerated compartment. Because the design and way of operation of absorption cooling units with pressure equalising gas is generally known, its closer description here is superfluous and furthermore not necessary for the description of the invention.

The evaporator pipe 11 which, in this example, is straight and essentially horizontal, penetrates into the thermal insulation 4 at the rear wall of the refrigerated compartment 2.

With this arrangement neither the cooling unit 10 nor its evaporator 11 require depth or useful space with respect to the refrigerated compartment 2. Through the direct contact between the evaporator 11 and the thermally well conducting inside wall 5, a very efficient cooling is obtained. With this type of refrigeration the major part of the heat penetrating through the thermal insulation is captured through the refrigerated inside wall 5 before it gets into the refrigerated space.

Essential advantages can be obtained in comparison to previously known refrigerated bar cabinet designs already then, without leaving the scope of the present invention, when the evaporator 11 is not placed, like in FIG. 1, inside the insulation, but is penetrating into the refrigerated compartment, parallel to its rear wall and is fitted there, if necessary, with fins or other heat transfer enhancing parts.

Between the evaporator 11 and the other parts of the cooling unit 10 is to be found inside the same straight tube the gas heat exchanger, most part of which lies within the thermal insulation 4 as well.

FIG. 2 shows in a vertical cut through the rear wall of the refrigerated compartment a possible way of fastening the evaporator to the high heat conductivity rear wall of the refrigerated compartment.

The plastic inside wall 21 is covered with aluminium sheet 22 to which an aluminium profile 23 for housing the evaporator pipe 24 is fastened in a suitable way. The thermal insulation 25 has an opening 27 which enables the evaporator pipe 24 to be introduced or removed from or toward behind during the assembly or disassembly of the cabinet and the cooling unit. Since the aperture angle of the elastic aluminium profile 23 is less than 180 degrees, it can hold fast the evaporator pipe 24 even without further fastening measures. The opening 27 of the thermal insulation is closed with a plug 26 made of insulating material.

FIG. 3 shows a further possibility to fasten the evaporator. In this case the evaporator pipe 32 is introduced from the side into the hollow space 34 which is created by the aluminium profile 33 within the thermal insulation. The aluminium profile 33 itself is fastened by suitable means to the highly thermal conducting rear wall 31 of the refrigerated compartment. The heat conductive contact between the aluminium parts 31 and 33 and the evaporator pipe 32 can be improved by the application of a heat transfer paste.

FIG. 4 shows schematically a secondary cooling system for the improved transfer of the cooling between the evaporator and the inside wall of the refrigerated compartment.

Attached to the rear wall 41 of the refrigerated compartment lies, within the insulation, besides the evaporator pipe 42 also a coil which has been first evacuated and thereafter charged with liquid and sealed hermetically.

The upper section 44 of the coil 43, which is in contact with the evaporator 42, acts as condenser. The vapor liquefied in the condenser gets through the drop leg section 45 into the lower section of the coil 43 and rises then from there due to vapor generation through heat inleak as vapor or vapor-liquid mixture anew up to the condenser section 44. It goes without saying that such secondary cooling system does not need to be restricted to the rear wall of the refrigerated compartment.

FIG. 5 shows in a vertical cut an arrangement which enables to produce ice cubes although the evaporator 54 is hidden inside the insulation 55.

An aluminium profile 56 is fastened by suitable means, e.g. with glue, rivet, screws, spot-welds, to the good heat conducting rear wall 51 of the refrigerated compartment. A second aluminium profile 57 fits into the first aluminium profile 56.

The vertical section 58 of the profile 57 is pressed through profile 56, opposing the evaporator 54, against the refrigerated wall 51 and thereby efficiently cooled.

The upper horizontal section of profile 57 serves as support for ice trays. With this arrangement profile 57 can be fitted or removed by the user at will again and again.

When space is very restricted, it can be of essential advantage to fit the refrigerated compartment, or both compartments, with sliding instead of hinged doors.

It is an interesting possibility to expose the content of the bar cabinet, even at closed doors, by the use of transparent insulating glass multipanes.

I claim:

1. Bar cabinet (1) consisting of at least one thermally insulated compartment (2) which is refrigerated by means of an absorption cooling unit (10, 11) with pressure equalizing gas and of at least one other, non refrigerated compartment (3) beside the refrigerated compartment (2) characterized thereby that those parts (10) of the absorption cooling unit which are not cold during operation, are placed behind the non refrigerated compartment (3).

2. Bar cabinet according to claim 1, characterized thereby that the inside walls (5, 21, 31, 51) of the thermally insulated and refrigerated compartment (2) is either made entirely or partially of material with high thermal conductivity, preferably of aluminium sheet, or is covered on its outside which faces the thermal insulation (4) with material with high thermal conductivity (22) and is cooled by contact with the evaporator (11, 24, 32, 54) of the absorption cooling unit (10).

3. Bar cabinet according to claim 1 or 2, characterized thereby that the evaporator (11, 24, 32, 54) of the absorption cooling unit (10) is arranged within the thermal insulation (4, 25, 34, 55), in contact with the outside face of the inside wall (5, 31, 51) of the refrigerated compartment (2) consisting of or covered with material of high thermal conductivity.

4. Bar cabinet according to claim 1 or 2 characterized in that a profile of a material with high thermal conductivity, which can house and hold the evaporator is fastened to one of a thermally well conducting inside wall and an inside wall cover of the refrigerated compartment.

5. Bar cabinet according to claim 1 or 2 characterized in that at least one sealed coil charged with heat transfer fluid and acting as a secondary cooling system is attached to that side of an inside wall of the refrigerated compartment which faces the thermal insulation.

6. Bar cabinet according to claim 1 or 2 characterized in that a profile of a material with high thermal conductivity is fastened for the purpose of ice cube makin along an inside wall of the refrigerated compartment in the region opposite the evaporator.

7. Bar cabinet according to claim 1 or 2 characterized in that its total depth does not exceed 30 cm.

8. Bar cabinet according to claims or 2 characterized in that the refrigerated compartment is fitted with one or more thermally insulated sliding doors.

9. Bar cabinet according to claim 1 or 2 characterized in having a door to the refrigerated compartment made of thermally insulating glass multipanes.

10. A bar cabinet comprising a thermally insulated refrigerated compartment including a heat conductive inside wall defining a chamber therein;

a non-refrigerated compartment adjacent said refrigerated compartment; and an absorption cooling unit disposed behind said non-refrigerated compartment, said cooling unit having an evaporator pipe extending therefrom into direct heat-conductive contact with said wall of said refrigerated compartment.

11. A bar cabinet as set forth in claim 10 wherein said refrigerated compartment includes a layer of thermal insulation about said wall and said evaporator pipe is disposed within said layer of thermal insulation.

12. A bar cabinet as set forth in claim 10 which further comprises at least one profile element of high thermal conductivity securing said evaporator pipe to said wall.

13. A bar cabinet as set forth in claim 10 having a depth of not more than thirty centimeters.

14. A bar cabinet as set forth in claim 10 which further comprises at least one sealed coil charged with heat transfer fluid attached to said wall and in contact with said evaporator pipe to define a secondary cooling system.

15. A bar cabinet comprising a thermally insulated refrigerated compartment having a heat conductive inside wall;

a non-refrigerated compartment horizontally disposed to and adjacent with said refrigerated compartment; and an absorption cooling unit disposed behind said non-refrigerated compartment, said cooling unit having an evaporator pipe extending therefrom into direct heat-conductive contact with said wall at a rear of said refrigerated compartment.

16. A bar cabinet as set forth in claim 15 wherein said refrigerated compartment includes a layer of thermal insulation about said wall and said evaporator pipe is disposed within said layer of thermal insulation.

17. A bar cabinet as set forth in claim 15 which further comprises at least one profiled element of high thermal conductivity securing said evaporator pipe to said wall.

18. A bar cabinet as set forth in claim 15 wherein each said compartment is of a depth of not more than thirty centimeters.

19. A bar cabinet as set forth in claim 15 which further comprises at least one sealed coil charged with heat transfer fluid attached to said wall and in contact with said evaporator pipe to define a secondary cooling system.

* * * * *